United States Patent [19]

Benderoff

[11] Patent Number: 4,644,688

[45] Date of Patent: Feb. 24, 1987

[54] SECURITY DOOR

[76] Inventor: Lawrence Benderoff, 23605 Riverview, Southfield, Mich. 48034

[21] Appl. No.: 658,406

[22] Filed: Oct. 5, 1984

[51] Int. Cl.[4] ..... E05C 7/02

[52] U.S. Cl. ..... 49/67; 70/56; 70/423

[58] Field of Search ..... 49/67, 55, 56, 57, 50, 49/163; 70/DIG. 60, 423, 56, 54

[56] References Cited

U.S. PATENT DOCUMENTS

| | | | |
|---|---|---|---|
| 141,833 | 8/1873 | Taylor | 70/424 |
| 592,300 | 10/1897 | Lyon | 70/423 |
| 1,244,404 | 10/1917 | Ankovitz | 70/56 |
| 2,177,617 | 10/1939 | Hinton | 49/56 |
| 2,728,388 | 12/1955 | Noecker | 49/57 X |
| 3,334,501 | 8/1967 | Greenwald | 70/423 |
| 3,606,423 | 9/1971 | McCarthy | 70/55 X |
| 3,718,014 | 2/1973 | Degadillo | 70/56 |
| 3,832,805 | 9/1974 | Stevens | 49/67 X |
| 4,026,070 | 5/1977 | Hicks | 49/55 |
| 4,113,291 | 9/1978 | Cameron | 70/424 X |
| 4,228,669 | 10/1980 | Bischoff | 72/DIG. 60 |
| 4,274,228 | 6/1981 | Kondracki | 49/56 |
| 4,300,369 | 11/1981 | Besecker | 70/56 X |
| 4,535,612 | 8/1985 | Seremet | 70/56 |

*Primary Examiner*—Philip C. Kannan
*Attorney, Agent, or Firm*—Rhodes and Boller

[57] ABSTRACT

In a building equipped with an outward swinging security door of the type having a double cylinder mortise type key lock mounted in a grille type metal structure characterized by an assembly of interconnected welded rod-like members with spaces therebetween, a means is provided which is immediately available to occupants of the building for locking and unlocking the security door when a corresponding inward swinging prime outer door of the building, spaced away from and rearward of the security door, is opened and is out of view of and inaccessible when the prime door is closed to persons attempting to unlawfully enter the building. The means which is immediately available to occupants for locking and unlocking the security door comprises a rearward opening tubular housing attached to the rearward portion of the security door and a key inside of the housing engaging the rearmost cylinder of the lock. The tubular housing which encloses the key has a length which substantially spans the space between the security door and prime outer door when both are in closed positions.

11 Claims, 6 Drawing Figures

SECURITY DOOR

BACKGROUND OF THE INVENTION

1. Field of the Invention

This invention is related to security doors and more particularly to the type of security doors having double cylinder key locks to permit the locking and unlocking of the security doors from either the inside or outside of buildings.

2. Description of Related Art

Grille type metal security doors are commonly used in combination with prime outer doors to enhance the security of residential and commercial buildings. The security doors are generally installed forward of and in spaced apart relationship to the prime outer doors and substantially fill the openings of the prime outer doors. They are characterized by assemblies of welded tubular or solid rod-like members in the form of open grille-type structures. As used herein, the term "security door" includes a grille-type structure made primarily from metal having open spaces between the grille members, commonly called a security door gate or guard, as well as a grille-type structure made of metal and glass having spaces between the grille members spanned by glass, commonly called a security storm door.

It is a common practice with security doors to maximize their effectiveness by incorporating key locks which allow users the alternative of locking or unlocking security doors from the inside or outside so that they can be made operational in occupied as well as unoccupied buildings.

The common means for providing this feature is the double cylinder mortise type key lock which can be actuated with a key from either the forward or rearward side of the lock. By way of example is the so-called double cylinder dead bolt key lock having lock cylinders and keyways on the forward and rearward sides of the lock.

Although the foregoing practice for maximizing security door effectiveness is in common use, it violates most local building codes and is fraught with risk to occupants of buildings for the reason that keys are seldom readily accessible to all of the occupants during emergency situations for the unlocking of security doors. It will be appreciated that this risk is greatest to sleeping occupants during the hours of the night.

Inasmuch as there are spaces between the grille bars of security doors, when keys are left engaged in the rear lock cylinders of existing doors, either inadvertently or intentionally, to insure their immediate availability for emergency egress from a building, the security of the building is placed in jeopardy because the keys are in plain view through the grille bars of the doors and accessible to persons attempting to unlawfully enter the building.

With the foregoing in mind, an important need clearly exists to provide an immediate available means to occupants of a building, having double cylinder key lock security doors, for unlocking said doors during emergency egress from the building without diminishing the current level of security which is provided by the security doors.

SUMMARY OF THE INVENTION

The present invention is an improved security door comprising an outward swinging open grille-type structure particularly adapted to be mounted in spaced relationship in front of an inward swinging prime outer door of a residential or commercial building. A double cylinder key lock, mounted in said grille-type structure, can be actuated from either the forward or rearward side of the cylinder lock. Means are provided for pivotally mounting the grille-type structure to the frame of an entranceway of a corresponding prime outer door of said building.

A rearward opening housing fixedly mounted to the rear side of said grille structure completely surrounds the rearward cylinder of the key lock such that said cylinder is substantially enclosed when the prime outer door is in a closed position whereby a spare key may be stored in said housing and engaged in said rearward cylinder for the immediate use of all of the occupants of the building, during emergency egress therefrom, without exposing said key to persons attempting to unlawfully enter said building.

It is a primary object of the present invention to provide a means in a security door having a double cylinder key lock for unlocking the security door during emergency egress from the building which is in plain view of and immediately available to occupants but out of view of and inaccesible to persons attempting to unlawfully enter said building.

It is another object in addition to the foregoing object to provide in a security door having a double cylinder key lock, a convenient means for storing a spare key which is in plain view of and immediately available to occupants of a building for locking the security door so as to enhance the security of the building without being in plain view of and accessible to persons attempting to unlawfully enter said building.

It is another object in addition to the foregoing objects to provide a low cost affordable means of insuring the safe emergency egress of all occupants of a building equipped with security doors having double cylinder key locks.

Other features and benefits of the invention will become apparent from the ensuing description and accompanying drawings which disclose the invention in detail. A preferred embodiment is disclosed in accordance with the best mode contemplated in carrying out the invention and subject matter in which exclusive property rights are claimed is set forth in the numbered claims at the conclusion of the description.

DESCRIPTION OF THE PREFERRED EMBODIMENT

Figure 1:
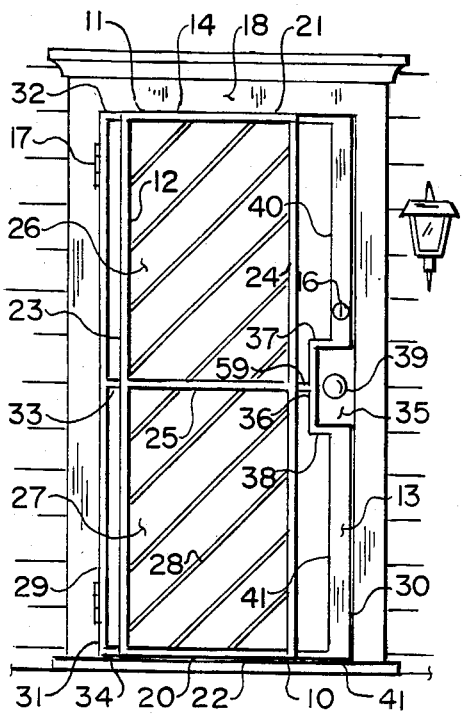
FIG. 1 is a front elevation view of a double cylinder key lock security door guard constructed in accordance with the present invention
Figure 2:
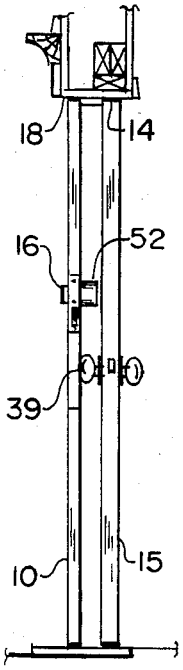
FIG. 2 is a side elevation view showing the security door guard of FIG. 1 together with the prime door of the building.

Referring now to the drawings wherein like reference characters refer to like and corresponding parts throughout the several views, the particular embodiment disclosed in FIGS. 1 through 4, inclusive, for the purpose of illustrating the invention, is an outward swinging security door guard 10 having a rectangular grille panel 11 comprised of an assembly of interconnected lengths of slender metal box section tubular and bar type members 12, an adjusting means 13 for sizing the width of said door guard 10 to the opening 14 of an inward swinging prime outer door 15, a double cylinder key lock 16 housed in the door guard 10, a means 17 for pivotally mounting the door guard 10 to the frame 18 of the entranceway of the prime door 15 and a means 19 for locking and unlocking the door guard lock 16, said means 19 for locking and unlocking the door guard lock 16 being in plain view and immediately accessible to occupants of said building when the prime door 15 is opened but inaccessible to persons attempting to make unauthorized entries into the building when the prime door 15 is closed.

The rectangular grille panel 11 has an outer frame 20 comprised of a horizontal upper member 21, a horizontal lower member 22, a vertical left side frame member 23 and a vertical right side frame member 24. A horizontal center member 25 divides the grille panel 11 into an upper portion 26 and a lower portion 27. The center frame member 25 is attached at one end thereof to the vertical left side frame member 23 and at the other end thereof to the vertical right side frame member 24.

A plurality of parallel diagonal members 28 extend across the upper 26 and lower 27 portions of the grille panel 11 and the end portions of said diagonal members 28 are attached to the outer frame 20 of the grille panel 11. The slender rod-like members 12 of the security door 10 are preferably lengths of straight metal tubes or bars and are joined together by welding or some other suitable means.

The horizontal upper 21, center 25 and lower 22 grille panel members are open ended and slideably receive telescoping left 29 and right 30 sidemembers for adjusting the security door width during installation to conform to the opening 14 of the prime door 15. A telescoping left 29 sidemember has a vertical portion 31 and adjoining horizontal upper 32, center 33 and lower 34 portions which slideably engage the corresponding horizontal upper 21, center 25 and lower 22 members of the grille panel 11.

The telescoping right sidemember 30, which slideably engages the upper 21 center 25 and lower 22 members of the grille panel 11, is of similar construction to the telescoping left sidemember 29, except for a center recess 35 formed by a vertical member 36 and adjoining horizontal upper 37, center 59 and lower 38 members, for providing clearance to the prime door knob 39. During installation of the door guard 10, the telescoping left 29 and right 30 sidemembers are fixed to the grille panel 11 by welding or other suitable means after adjusting the door guard 10 to conform to the width of the prime door 15.

The upper 40 and lower 41 vertical portions of the telescoping right sidemember 30 are somewhat wider than the other door members and the upper vertical member 40 provides a housing for the lock 16 which secures the door guard 10 to the frame 18 of the entranceway of the prime door 15.

The lock 16 is a conventional double cylinder swinging dead bolt key lock or any other suitable double cylinder type key lock. A rectangular aperture 42 extends laterally through the telescoping right sidemember 30 and receives the swinging dead bolt assembly portion 43 of the double cylinder lock 16. The face plate 44 of the dead bolt assembly portion 43 of the lock 16 is fixedly secured to the telescoping right sidemember 30 with threaded fasteners 45.

A pair of hinges 17 is fixedly attached to the telescoping left sidemember 29 and the frame 18 of the entranceway of the prime outer door 15 and provides a means 17 for pivotally mounting the door guard 10 to the prime door frame 18.

Extending longitudinally through the upper portion 40 of the telescoping right sidemember 30 are aligned apertures 46 which receive the forward cylinder 47 and the rearward cylinder 48 of the lock 16, said forward 47 and rearward cylinders 48 operatively engaging the dead bolt assembly portion 43 of the lock 16. The shouldered portions 49 of the forward 47 and rearward 48 lock cylinders project outwardly from their respective mounting surfaces 50 and 51 on the right sidemember 30.

Figure 3:
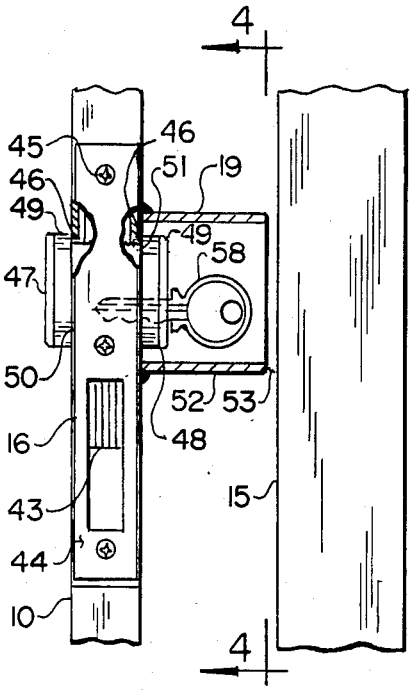
FIG. 3 is an enlarged partially sectioned fragmentary view of the security door guard with a rearward extending tubular housing of FIG. 2 showing a key inside of said housing engaged in the lock of said door guard.
Figure 4:
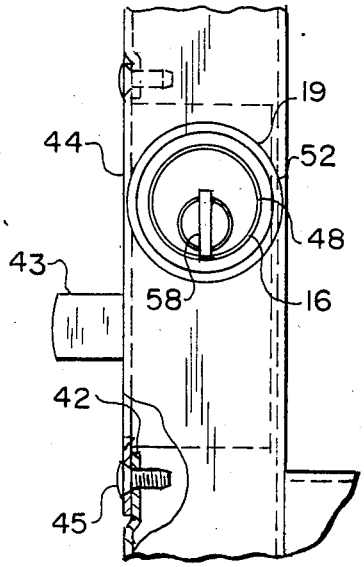
FIG. 4 is an enlarged partially sectioned fragmentary view taken along the line 4—4 of FIG. 3.

The means 19 for actuating the lock 16, in plain view and immediately available to occupants of a building, is best seen in FIGS. 3 and 4. The forward end portion of a rearward opening cylindrical tubular housing 52 surrounding the shouldered portion 49 of the rear cylinder 48 of the lock 16 is fixedly secured by welding or other suitable means to the rear surface 51 of the vertical member 40 which houses the dead bolt lock 16.

The tubular housing 52 is of sufficient length such that, except for a small clearance gap 53 at the rear of the housing 52, said housing 52 substantially spans the space between the door guard 10 and prime door 15. When the prime door 15 is in a closed position, the length and thickness of the housing 52 are sufficient to bar access of unauthorized persons to a spare key 58 stored within the interior of the housing 52 which engages the rear cylinder 48 of the lock 16.

It will be appreciated that when the prime door 15 is opened by an occupant, the key 52 is immediately presented in plain view to an occupant of said building and is made accessible for locking the door guard 10 to secure the building or for unlocking said door guard 10 during an emergency egress from said building.

Figure 5:
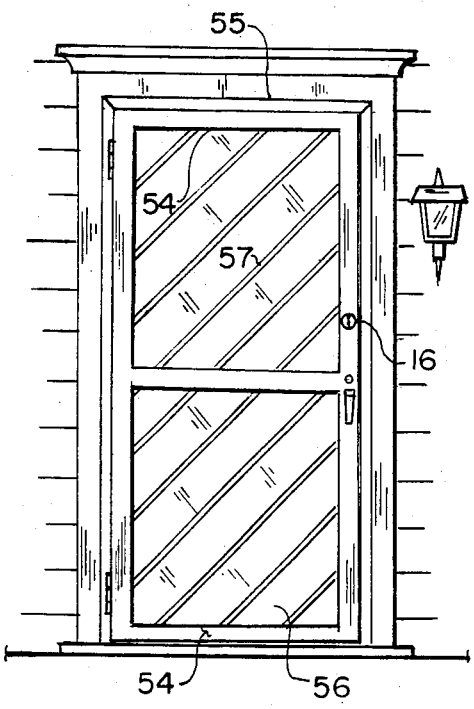
FIG. 5 is a front elevation view of an alternate embodiment, having the form of a security storm door, mounted in the door opening of a building.
Figure 6:
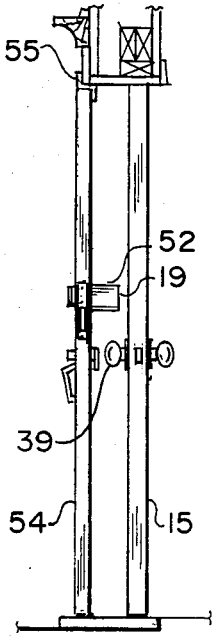
FIG. 6 is a side elevation view showing the security storm door of FIG. 5. together with the prime door of the building.

Referring now to FIGS. 5 and 6, a second embodiment of a double cylinder key lock security storm door 54 is disclosed therein having a similar appearance to the door guard 10 heretofore disclosed. The security storm door 54 is of a fixed width and pivotally mounted to a metal storm door frame 55 which is attached to the frame 18 of the entranceway of the prime outer door 15.

It will be observed from FIG. 6, that the security storm door 54 is spaced at a greater distance from the prime door 15 whereby sufficient clearance is provided between the storm door 54 and prime door knob 39. A removable glass panel 56 of conventional construction is mounted within the security door outer frame 55, directly behind the spaced diagonal bars 57, and a conventional screen panel (not shown) may be substituted in lieu of said glass panel 56. Fixedly attached to the rear surface of the storm door 54 is the type of tubular housing 52, heretofore disclosed, for storing a spare key 58 in the rear cylinder 48 of said lock 16.

From the foregoing description, it will be appreciated that the present invention provides a low cost and affordable means immediately available to occupants of a building of a safe emergency egress through security doors having double cylinder key locks together with the alternative of locking said doors to enhance the security of said building.

Although but two embodiments of the present invention have been disclosed herein, it is obvious that other embodiments can be constructed by varying the size, shape and arrangement of elements of the invention without departing from the spirit thereof.

I claim:

1. A lockable security door having a means immediately available to occupants of a building for locking and unlocking said security door comprising, in combination:

(a) a security panel adapted for being pivotally mounted in the entranceway of a building forward of, in spaced apart relationship to a prime outer door of the building;

(b) a means for pivotally mounting the security panel to the entranceway of the building;

(c) a key lock mounted in the security panel for locking and unlocking the security door, said key lock having a lock cylinder mounted in the rear portion of the security panel for receiving a key to lock and unlock the security door; and (d) a rearward opening housing surrounding the lock cylinder for enclosing the key, said housing having a length which substantially spans the space between the prime outer door and the security door when both doors are in their closed positions whereby when a spare key is inserted into and kept in the locked cylinder, the key is in plain view when the prime door is open and is immediately available to occupants of the building for locking and unlocking the security door, but when the prime door is closed, the key is out of view of and inaccessible to persons attempting to unlawfully enter said building.

2. The structure according to claim 1 wherein said key lock is a double cylinder dead bolt lock.

3. The structure according to claim 1 wherein said means available to occupants for locking and unlocking said security door comprises a rearward opening housing attached at one end thereof to a rear portion of said security panel for storing a spare key engaged with said lock, said housing surrounding said lock and having a length which substantially spans the space between the prime outer door and said security panel whereby when said prime outer door is opened and said security door is fixed to said building, said key is in plain view and immediately available to said occupants and when said prime outer door is closed said key is not in view of and inaccessible to persons attempting to unlawfully enter said building.

4. The structure according to claim 3 wherein said housing is a cylindrical tube fixedly secured at one end thereof to the rear portion of said security panel and is open at the other end thereof.

5. The structure according to claim 1 wherein said security panel comprises a rectangular shaped frame having interconnected slender rod-like members, said interconnected members comprising a first vertical outer side member for housing said lock, a second vertical outer side member spaced apart from and disposed parallel to said first vertical member; spaced apart parallel upper, center and lower horizontal members disposed between and fixedly attached to said vertical members; and a plurality of spaced apart parallel slender rod-like members spanning the space between said frame members and fixedly attached at the ends thereof to said frame members.

6. The structure according to claim 5 further comprising a panel of glass with a metal outer frame disposed rearward of said spaced parallel members, said glass panel substantially spanning the space between the frame members of said security panel.

7. The structure according to claim 5 further comprising a telescoping member engaging each side of said security panel for adjusting the width of the security door to conform with the width of the prime outer door.

8. A double cylinder key type lock security door guard having a means immediately available to occupants for locking and unlocking said security door comprising, in combination:

(a) a rectangular shaped grille panel adapted for being pivotally mounted forward of and spaced apart from a prime outer door of a building comprising a rectangular frame having slender rod-like interconnected members, said members comprising a first vertical outer sidemember for housing a lock, a second vertical outer sidemember spaced apart from and parallel to said first vertical outer sidemember, and spaced apart parallel upper, center and lower horizontal members disposed between and fixedly attached to said vertical frame members and a plurality of spaced apart parallel members spanning the space between said grille panel frame members fixedly attached at the ends thereof to the members of said grille panel frame;

(b) a means for pivotally mounting said grille panel to the frame of the entranceway of said corresponding prime outer door;

(c) a double cylinder dead bolt key lock mounted in one of said grille panel vertical rectangular outer sidemembers.

(d) a key engaging the rearmost cylinder of said lock; and (e) a rearward opening housing entirely enclosing said key and being of a length substantially spanning the space between said corresponding prime outer door and said security door when said doors are in closed positions whereby said key is in plain view and immediately available to occupants of a building when said prime outer door is opened for locking and unlocking said lock but out of view of and inaccessible to persons attempting to unlawfully enter said building when said prime outer door is closed.

9. The structure according to claim 8 wherein said security door is a storm door.

10. In a security door having a double cylinder key type lock spaced apart from and positioned forward of a prime outer door of a building a means in plain view immediately available to occupants of said building for locking and unlocking said lock when said prime outer door is in an open position comprising a rearward opening tubular housing fixedly attached to the security door having a length substantially spanning the space between the security door and prime outer door for storing a key and a key within said housing engaging said lock.

11. The structure according to claim 10 wherein said security door is a security door guard.

* * * * *